US006151911A

United States Patent [19]

Dando et al.

[11] Patent Number: 6,151,911

[45] Date of Patent: Nov. 28, 2000

[54] RELATING TO COOLING CONTAINERS OF BEVERAGES

[75] Inventors: William Dando, Derbyshire; John Lawrence, Birmingham, both of United Kingdom

[73] Assignee: Bass Public Limited Company, United Kingdom

[21] Appl. No.: 09/235,847

[22] Filed: Jan. 22, 1999

[30] Foreign Application Priority Data

Jan. 24, 1998 [GB] United Kingdom ..... 9801436

[51] Int. Cl.[7] ..... F25D 3/08

[52] U.S. Cl. ..... 62/457.3; 62/480; 62/371

[58] Field of Search ..... 62/480, 457.3, 62/371

[56] References Cited

U.S. PATENT DOCUMENTS 4,736,599 4/1988 Siegel ..... 62/480
4,928,495 5/1990 Siegel ..... 62/480
5,079,932 1/1992 Siegel ..... 62/480
5,154,067 10/1992 Tomizawa et al. ..... 62/480
5,692,381 12/1997 Garrett ..... 62/480
5,732,569 3/1998 Sanada et al. ..... 62/480

*Primary Examiner*—William Doerrler
*Assistant Examiner*—Mark Shulman
*Attorney, Agent, or Firm*—Foley & Lardner; Michael D. Rechtin

[57] ABSTRACT

A beverage pack comprises a container (28), beverage (41) held in the container (28), and beverage cooling means (10) provided in, or in association with, the container (28) and comprising a phase-change medium (22) such as water adapted in use to change phase and thus extract heat from the beverage. Adsorption or absorption means (20) such as activated carbon, ammonium nitrate, and a polymer may be provided to adsorb or absorb the phase-change medium (22). The phase-change medium may be arranged to vaporize into a vaporization chamber (26) at sub-atmospheric pressure.

25 Claims, 7 Drawing Sheets

RELATING TO COOLING CONTAINERS OF BEVERAGES

This invention relates to cooling containers of beverages, such as for example cans of beer or other fermented liquor or of soft drinks.

There have been proposals to cool cans of beer using in-can devices, or external devices applied to cans.

According to a first aspect of the invention we provide a beverage pack comprising a container, beverage held in the container, and, beverage cooling means provided in, or in association with, the container and comprising a phase-change medium adapted in use to change phase and extract heat from the beverage.

Preferably adsorption or absorption means is provided in use to adsorb or absorb the phase-change medium.

Preferably a cooling unit is provided and defines a vaporisation chamber, said phase-change medium vaporising into said chamber in use. The adsorption or absorption means is preferably provided so as to be communicable with said chamber. The cooling unit may comprise an in-can (or in-container) device.

Isolation means is preferably provided to isolate the adsorption or absorption means from the phase change medium until the cooling unit is activated via actuation means.

The actuation means may comprise a manually operable member, which may be a separate from any container-opening means that may be provided, or the actuation means may be arranged to operate upon opening of the container. For example, when the container is pressurised the cooling unit may be actuated by the change in pressure in the container that occurs upon opening the container.

The beverage preferably contains dissolved gas, such as carbon dioxide and/or nitrogen The beverage may be a malt or other fermented liquor such as beer, lager, ale, stout, porter, cider, or the like, or it may be a low alcohol or non-alcoholic drink.

The isolation means may comprise a valve, which may be openable and closable, or it may comprise an openable barrier which cannot be closed again (e,g. a rupturable membrane).

The adsorption or absorption means may be activated carbon, or ammonium nitrate, or a polymer. There are substances which can adsorb/absorb vapour without getting hot, and we prefer to have the adsorption means be one of these.

Preferably the phase change medium comprises water. The phase change medium may be substantially 100% water.

There may be low pressure provided in the cooling means above the phase change medium. There may be the adsorption or absorption means spaced from and separated from the phase change medium by a barrier (isolation means), and there may be low pressure either in the space between adsorption or absorption means and the barrier, or between the barrier and the phase change medium, or in both spaces. A closed housing, or other member, may enclose the operative components of the cooling means.

A low pressure above a liquid makes it vaporise more readily (e.g. at room temperature).

By "low pressure" we snean below-atmospheric pressure, and preferably substantially below atmospheric pressure. In many embodiments of the invention "low pressure" is a pressure low enough so that the phase change medium boils at temperatures experienced by a beverage in a can at room temperature (say, 20° C.) and even more preferably such that the liquid boils at 10° C., or 5° C., or even 2° C. or less (and even at sub zero temperatures). "Low pressure" may be vacuum, or practically vacuum.

We may provide a self-contained cartridge retained within a can of beverage (or other container of beverage), the self-contained cartridge possibly comprising a housing, adsorbent material retained in the housing, and an openable barrier provided in the housing and separating the water from the adsorbent material. There may be a space defined between the barrier and the water and/or the barrier and the adsorbent material, which space (or spaces) may contain a below atmospheric pressure gas, or be substantially evacuated.

We can control the amount of cooling by controlling how much phase change medium we use and/or how much adsorption/absorption means we use. Preferably the pressure is simply low enough to achieve rapid vaporisation of the liquid once the pressure of liquid vapour above the liquid is reduced (by adsorption).

The pressure in an unactivated cooling device above the liquid may be the partial pressure of that liquid at the temperature concerned.

A desiccant may be used in addition to or, instead of the adsorption means. If we can use something which has an endothermic reaction when it adsorbs/absorbs water this effect can also be used to cool the contents of the container. Ammonium nitrate is cheap and has an endothermic reaction. We may provide ammonium nitrate in the adsorption means, at least as one component.

The cooling unit may comprise an elongate member, such as a tube, with the phase change medium provided well spaced from the adsorption means (e.g. at opposite ends of the elongate member). This may help to avoid liquid, in liquid form, accidentally contacting the adsorption means and being adsorbed without first being vaporised (and extracting heat). Alternatively or additionally we may provide a "splash protector" which allows the passage of vapour but restricts or prevents the passage of liquid. A baffle, or series of baffles may do this. It may be possible to have a "no-wetting" device which protects the adsorption means from direct contact with liquid but allows vapour to pass. This could be useful should a user activate the cooling unit and then knock the can (or other container) over, or invert it. The "no-wetting" device may keep the adsorption/absorption means dry for only a few seconds or tens of seconds, or it may keep it dry for hours or days (when liquid would otherwise contact the adsorption means).

We may provide thermal insulation adjacent the adsorption means. We may provide a thermal insulating barrier in the wall that defines the vaporisation chamber. We prefer to have a good thermal conduction (e.g. metal) between the phase change medium (liquid) and the beverage, so as to facilitate heat extraction from the beverage.

The adsorption/absorption means may be provided in a cartridge, preferably a detachable cartridge. The cartridge may be adapted to be re-used after a re-activating operation (e.g. after beating it to drive out the phase change medium (e.g. water)). The cartridge may be re-attachable to the unit for re-use.

The cooling unit may be attached to the top wall of a container, or the bottom wall, or a side wall, or may be loose inside the container, e.g. free-floating.

According to a second aspect of the invention we provide a cooling unit adapted to cool beverage in a container, the unit comprising a phase change medium adapted to change phase and extract heat from the beverage.

The container may be a closed container, or the unit may be adapted to be inserted into an open or opened container (e.g. an opened can, or into a glass of beverage). The container may be a keg of "beer".

Preferably the unit comprises a closed chamber, preferably having adsorption or absorption means separated from the phase change medium by openable isolation means. When the isolation means is opened and the adsorption or absorption means is in communication with vapour from the phase change medium these phase change media may experience a pressure which is such that the phase change medium vaporises (vaporises enough to get significant cooling), and preferably boils, at 20° C. or less, 15° C. or less, (0° C. or less, 5° C. or less, about 0° C., or less).

According to a third aspect of the invention we provide a kit comprising at least one, and preferably a plurality of, beverage containers containing a beverage, and at least one cooling unit.

It will be appreciated that although we have discussed cooling beverages, and that is our main area of intended use, the invention is applicable to cooling other foodstuffs (e.g. ice-cream, yoghurt etc.). We seek protection for such a broader invention.

The invention may even be used to heat drinks or foodstuffs. If we use the heat that may be generated by adsorption instead of viewing it as undesirable, we could provide a beater instead of a cooler. Possibly by dipping an end of a beat transfer device ("cooling unit") into room temperature water, evaporating water trapped in the low pressure chamber and using the heat at the adsorption end produced during re-condensation to heat a substance to be heated).

We may not adsorb or absorb the heat transfer medium. It may escape to atmosphere, or it may be removed from the vaporisaiion chamber (to allow more liquid to vapour phase change to occur) and be stored in storage means which may or may not adsorb or absorb (and may re-condense).

According to another aspect of the invention we provide a method of cooling a beverage in a container comprising extracting heat from the beverage to cause a phase change of phase change medium.

Preferably the method further comprises providing a sealed chamber and providing the phase change medium in that chamber. The chamber may be at a low pressure, or evacuated. The chamber may have adsorption or absorption means which extracts vapour from the atmosphere inside the chamber, tending to reduce the pressure in the chamber, which tends to cause more vapour to be created from the liquid (or solid) phase change medium, thereby extracting heat.

The method may comprise providing a substantially evacuated region in the sealed chamber and initiating the cooling operation by allowing the pbase change medium, or vapour from it, access to what was previously evacuated region.

Embodiments of the invention will now be described by way of example only with reference to the accompanying drawings, of which:

Figure 1:
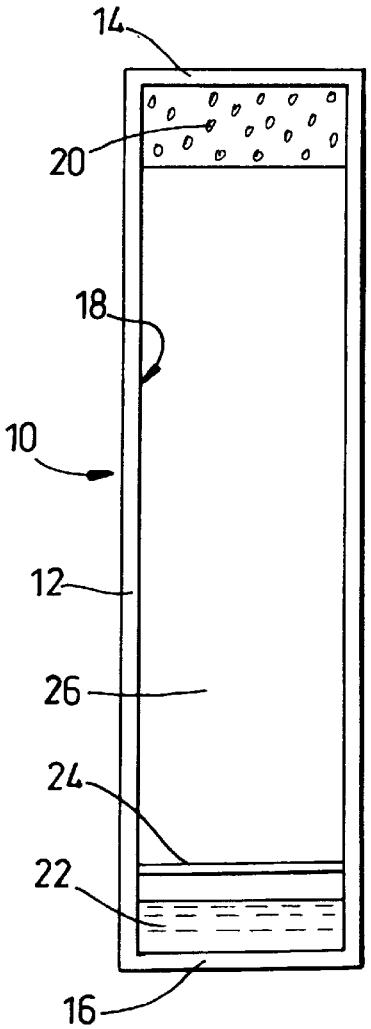
FIG. 1 shows a beverage cooling unit for use with a can of beverage.

Beverage cooling means constituted as a unit 10 is shown in FIG. 1 and comprises a cylindrical body wall 12, an upper closure wall 14, and a lower closure wall 16. The walls 12, 14, 16 form a sealed chamber 18. Provided in the chamber 18 at the upper end is a body of adsorbent material 20, in this case carbon. At the bottom end of the chamber 18 is a small volume of liquid water 22, and an isolating barrier 24 is provided between the water and the carbon. Between the water and the isolating barrier there is the vapour pressure of the water vapour given off by the liquid water 22. The space above the water is initially substantially evacuated during manufacture, and so the water vapour pressure above the water in an unactuated device is low. Between the barrier 24 and the carbon 20 there is a vacuum region, e.g. a sub-atmospheric pressure or low-grade vacuum region 26. The walls 12, 14, 16 are made of metal (e.g. steel or aluminium). They are preferably coated on the external surface, and/or on the inside surface, with a lacquer to prevent attack by beverage.

Figure 2:
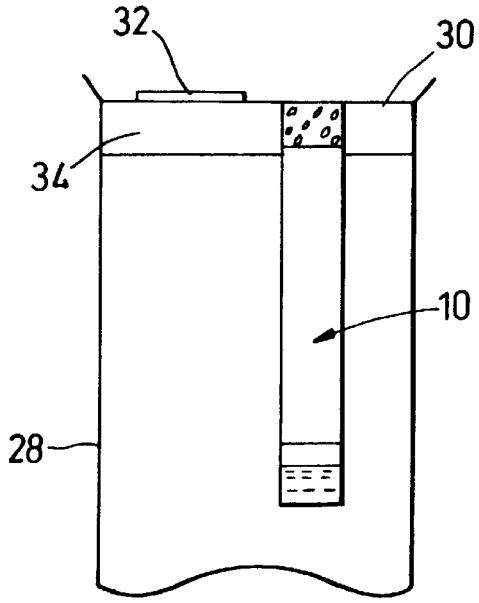
FIG. 2 shows a can of beer provided with the beverage cooling device of FIG. 1.

In use, at least the lower portion of the unit 10, and probably most of the unit 10 (if not all) will be immersed in a beverage inside a container, such as can 28 (see FIG. 2). The insulating barrier is opened (e.g. by opening a valve provided in it, or by rupturing a membrane, or in any other way). The small amount of waler vapour that is above the liquid water 22 just before the barrier is opened can, when the barrier is opened, expand into the vacuum. This has an expansion cooling effect. However, in addition to that, and more significant, is the fact that water vapour in the chamber 18 can now communicate with the adsorbent material 20 and be adsorbed by it, removing vapour from the chamber 18. More water vapour evaporates from the liquid 22 to replace that which is adsorbed. In order to evaporate vapour from the body of liquid 22 it is necessary to take in heat from the surroundings, chilling the liquid 22, the walls 12 and 16, and hence the beverage that is in contact with those walls.

In fact the pressure above the liquid 22 way be so low that the liquid boils, effecting very rapid chilling of the beverage. The efficiency of adsorption may also be such that boiling continues to occur. Alternatively, the liquid may not truly boil, but may simply evaporate very quickly indeed.

The liquid in the chamber 18 may be completely evaporated after, say, 5, 10, 15, 20, 30, 40 or more seconds. The adsorbent material may be saturated before all of the liquid is evaporated.

The performance of the liquid is such that in a standard 440 ml can, or even 500 ml can, we can expect a temperature drop of the beverage of at least 10° C., and preferably at least 12°, 14°, 16°, 18° or even 20° C. We would probably arrange things such that we do not get a temperature drop of any more than that 20° C. (or even a bigger drop than 15° C.) since we may not wish to freeze the beverage, at least when that is a malt or fruit liquor or soft drink.

It will be noted that the membrane 24 is close to the water 22. This maximises the available heat extraction due to expansion of gas.

As will be seen in FIG. 2, the unit 10 is affixed to the can end 30 and extends away from it. The openable closure for the can is referenced as 32.

It will be noted in FIG. 2 that there is a head space, referenced 34, which is about at, and in this example is on or slightly below, the level of the adsorbent material. The reason for this is because if we use charcoal/carbon the adsorbent will become hot as it adsorbs water vapour, and in order to avoid heating the beverage that we are trying to cool we prefer to provide a relatively large head space. However similarly, in order to prevent the user experiencing the heat (and possibly burning themselves) we may well insulate the adsorbent from the can end (or indeed any part of the can). Again in order to prevent the transfer of heat of adsorption back down wall 12 of the cooling unit 2 we may provide a plastic, or other insulating, ring in the wall of the tube, breaking the metal-to-metal conduction path.

Figure 3:
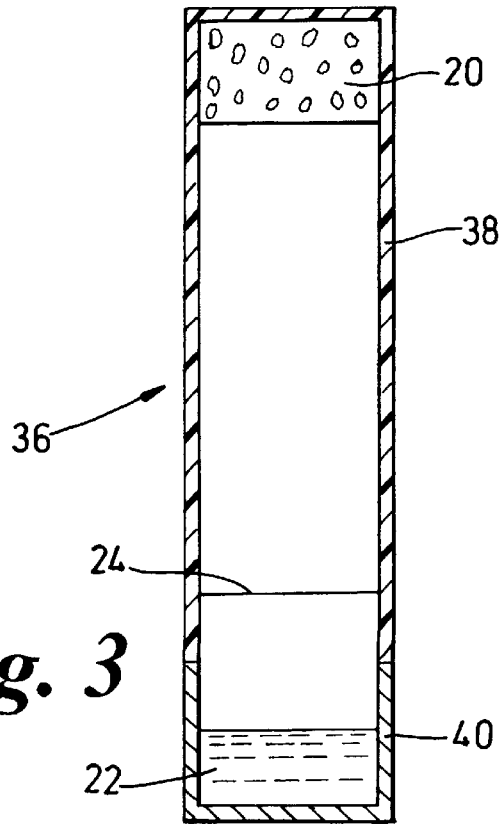
FIG. 3 shows a modified beverage cooling device.

FIG. 3 shows an alternative cooling unit, referenced 36. This is very similar to that of FIG. 1 except that the tubular can-defining walls of the unit are defined by two components, a plastics upper component 38 (poor thermal conductor) and a metal lower component 40 (good thermal conductor). This enables good thermal communication with the beverage at the region where beat is being extracted —in the region of the liquid water 32, and yet insulates the area which may make it hot.

In a modification of the arrangement shown in FIG. 3 the plastics component extends down only about as far as the level of the adsorbent material (so the metal component comprises the majority of the elongate extent of the housing that defines the chamber).

So far we have not said how we will open the isolating barrier 24. Any convenient way of doing this can be provided.

Figure 4:
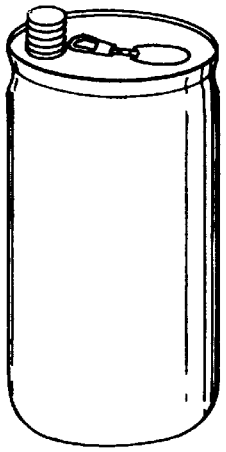
FIG. 4 shows a can of beverage provided with another cooling device.
Figure 5:
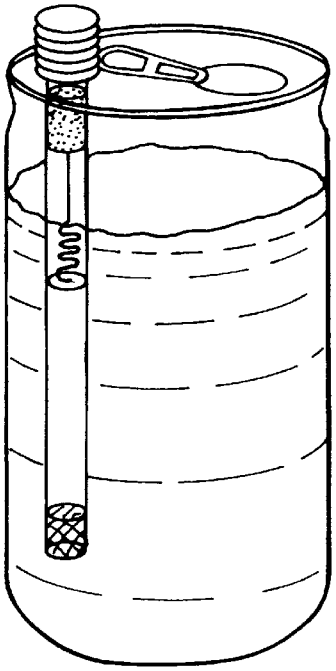
FIGS. 5–6 show more detail of the cooling device of FIG. 4.
Figure 6:
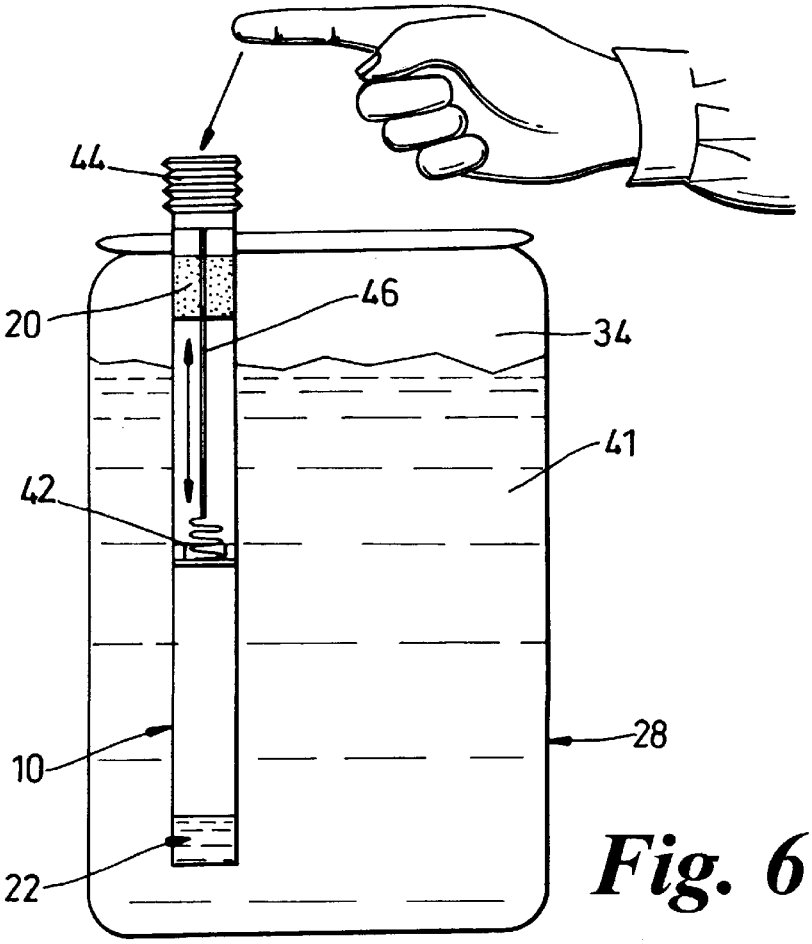

FIGS. 4 to 6 show an arrangement for cooling a beverage 41 (in this case a soft drink, but it could be beer, or any other drink) which is held in a container 28.

The cooling unit 10 has the isolating barrier provided about half way down the tube, and the isolating barrier comprises a one way valve 42. A bellows-like arrangement 44 is provided extending from the top of the can, and the compressible bellows actuation means is connected to the one way valve 42 via a strut or rod 46. The bellows is resiliently urging the rod 46 upwards.

In the arrangement shown in FIGS. 4 to 6 the one way valve is biased to its closed position, and is open only so long as the user presses down on the bellows 44. The user can therefore cool the drink to a degree that is under their own control. If they do not like their drink too cold they can keep the valve open for less time than if they like the drink colder.

This feature, user-controlled degree of cooling, preferably by having a manually openable/closable valve is not present in the "rupturable membrane" barrier systems.

It will be noted that the rod 46 extends through a hole in the adsorbent carbon block.

Figure 7:
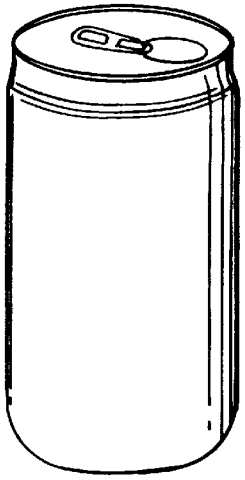
FIG. 7 shows another can of beverage fitted with a modified cooling device.
Figure 8:
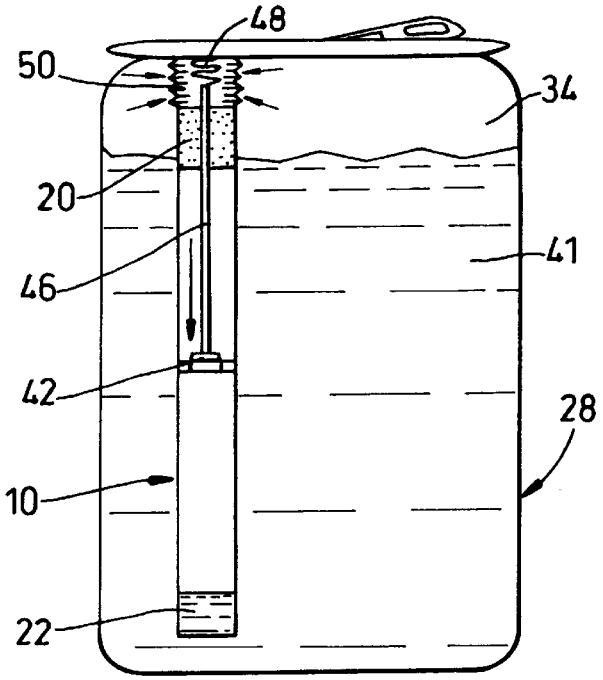
FIGS. 8–9 show more details of the modified cooling device of FIG. 7.
Figure 9:
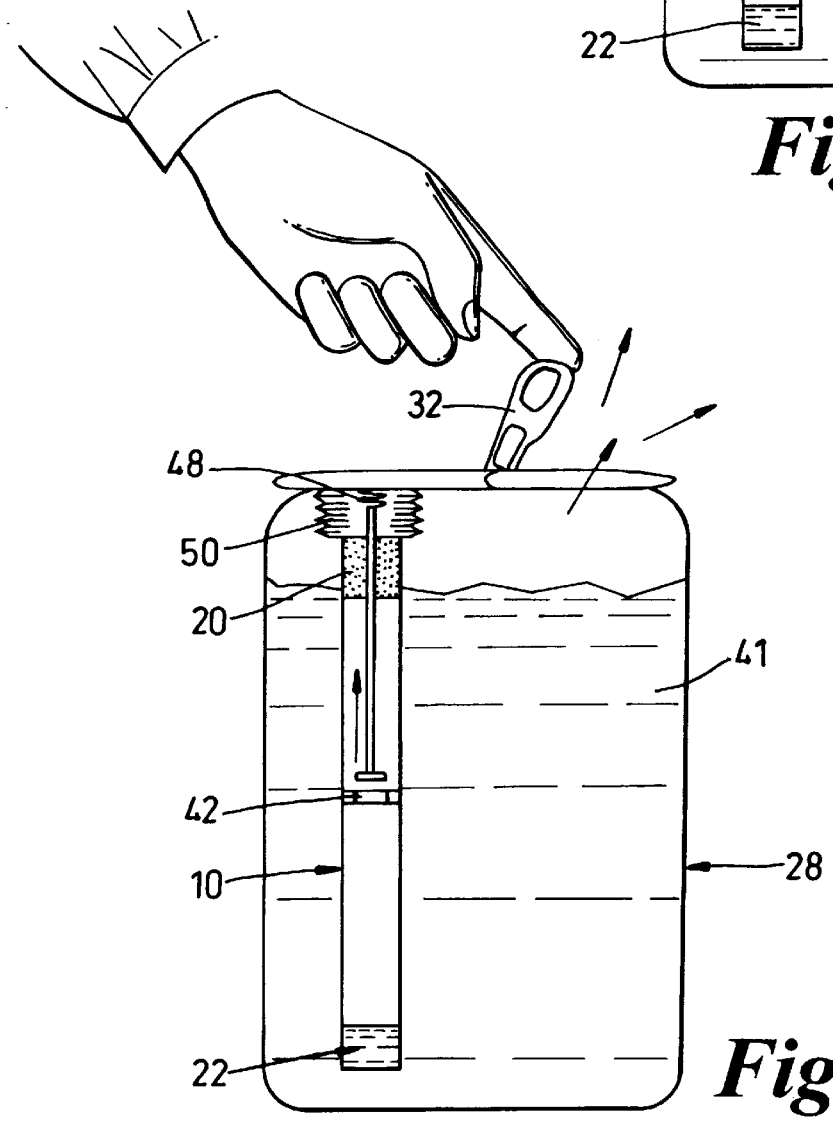

FIGS. 7 to 9 show an alternative can 28. In this arrangement the isolating barrier is opened by the action of opening the can closure 32. The reduction in pressure above the beverage held in the can, and equally a reduction in pressure acting on the cooling in it, causes a pressure-sensitive mechanism to open the isolating barrier.

In this case, the pressure-sensitive mechanism is a spring/biasing means 48 which urges the valve 42 provided in the isolating barrier to its open position, but which is prevented from moving the valve to its open position by the pressure in the can when the can is closed. The pressure in the can acts to keep bellows, this time referenced 50, in an extended position, until such time as the pressure is reduced when the spring 48 takes over.

Other ways of using the reduction in pressure of the can 28 to open the isolating barrier include using it to tear an isolating membrane. A component of the cooling unit could be pressurised by e.g. internal pressure/bias spring/by pressure-generation means, which pressure is countered by the above-atmosphere pressure in a closed container. When the pressure in the container falls to atmospheric pressure, due to the container being opened, the actuator is actuated, and the isolating membrane is torn.

Figure 10:
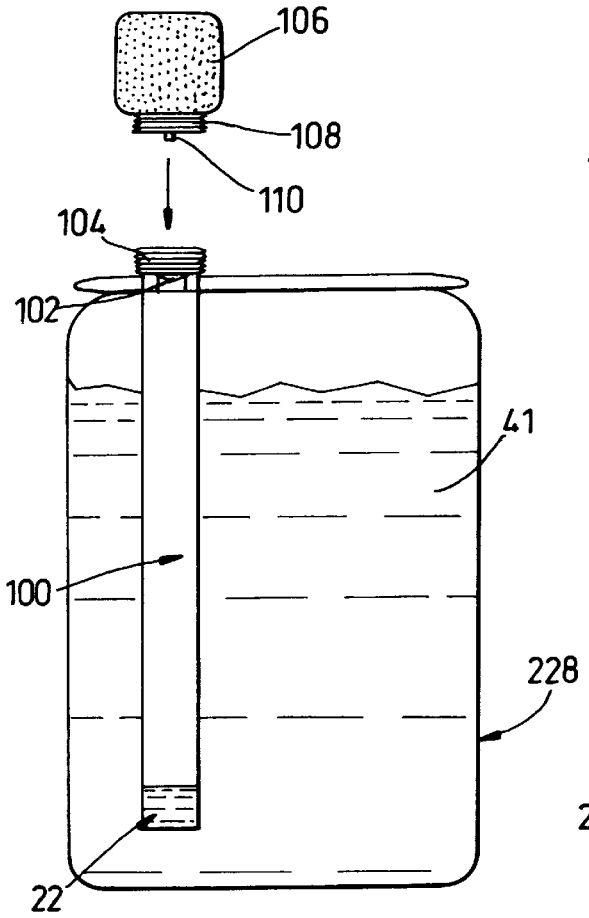
FIGS. 10 and 11 illustrate an alternative cooling device/can.
Figure 11:
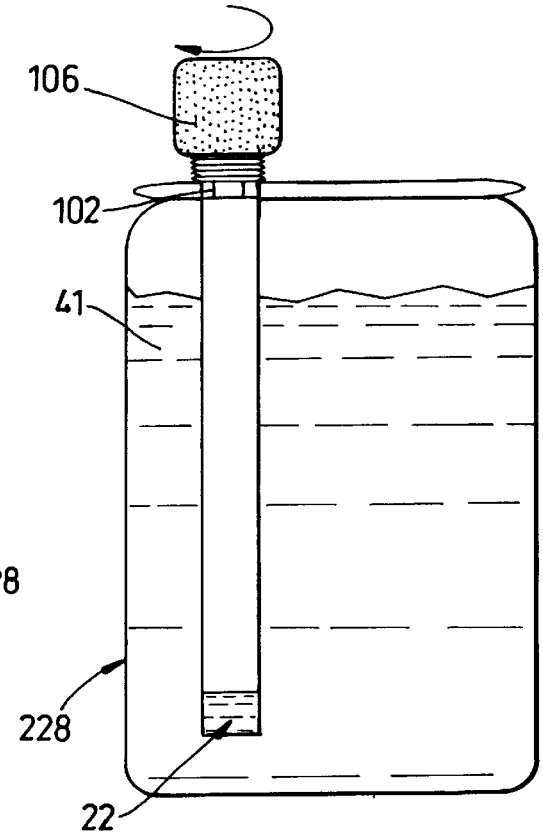

FIGS. 10 and 11 show another can cooling system. In this case the cooling unit, referenced as 100, is a chamber containing water at one end, and a low pressure/evacuated space above it, and a one way valve/closure membrane 102 at the other end A screw threaded formation 104 or other coupling means is included at the top of the elongate body of the unit, and projects from a drum or keg 228. An attachable and detachable adsorbent (e.g. carbon) cartridge 106 is also provided with a complementary screw threaded region 108. The cartridge 106 has a projection 110 which when the cartridge is moved to an operative position (in this case screwed on to an operative position) opens the valve, and allows water vapour to be adsorbed by the adsorbent cartridge.

Having a detachable cartridge may enable the user to use the same cartridge to chill a plurality of packaged beverages. Alternatively/additionally it may enable the user to apply more than one cartridge to the same container so as to chill it more than can be achieved by using a single cartridge. Alternatively/additionally we may provide the cartridges such that the user can re-activate them once they have been "spent" by absorbing as much water/other absorbable as they reasonably can. For example, they could be re-activated by putting them in an oven and baking out the water, or chemically.

Figure 12:
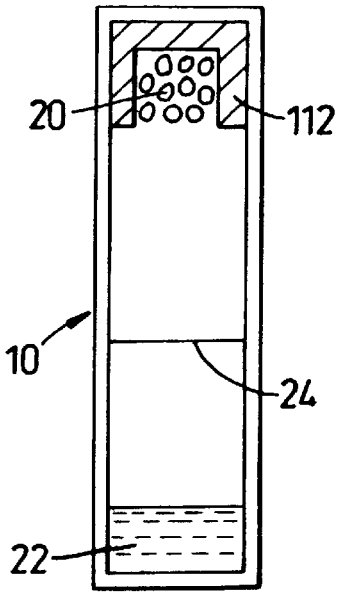
FIG. 12 shows a cooling device provided with insulation inside external closure walls.

FIG. 12 shows a cooling unit 10 in which an insulating insert 112 is provided around the absorbent material 20. It also shows the isolating barrier 24 provided roughly towards the middle of the elongate tube of the cooling unit 10.

Figure 13:
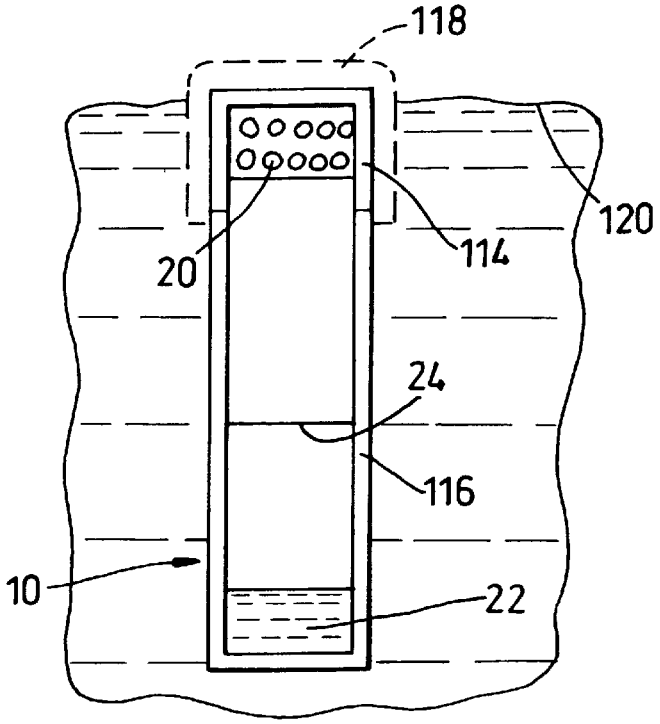
FIG. 13 shows a cooling device with insulation provided outside an external closure wall.

FIG. 13 shows an arrangement of cooling unit where a top cap of the cooling unit is provided in a thermal insulating material (e.g. plastics), with the lower portion 116 being provided in conductive material (usually metal).

FIG. 13 also shows in dotted outline the cooling "stick" having an "over-cap" 118 of insulating material which can be provided over a metal (or plastic) housing to increase the insulation. For example, this may be used where the housing of the cooling device is predominantly metal, but has a plastic "washer" in its wall to provide a thermal break.

FIG. 13 also shows the beverage, referenced 120 being above the lowermost level of the adsorbent material (which is now possible because it is thermally insulated).

Figure 14:
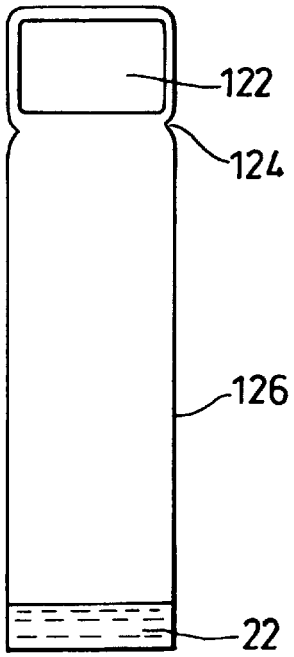
FIG. 14 shows the cooling device with an adsorbent/absorbent insert cartridge.

FIG. 14 shows a cartridge 122 of adsorbent material held in a separate housing (e.g. of steel coated in lacquer, or plastics material) defining a closed chamber by a "nip" 124. It may be convenient for us to provide the adsorbent material in a self-contained cartridge and locate/affix this in the tubular body/other body. In FIG. 14 the tubular body, reference 126 fully encloses the cartridge, but in other embodiments it may seal to it, and the wall of the cartridge may provide the exterior surface of the cooling unit. The cartridge 122 may have provided associated with it/integral with it the isolating barrier. For example, the cartridge may be moulded in plastics material and may have a thin film moulded in it which constitutes the isolating barrier. A mechanism may be provided to break the thin film in order to activate the cooling unit.

Figure 15:
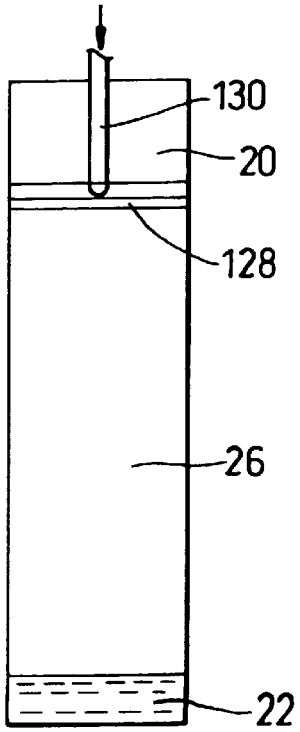
FIG. 15 shows the cooling device with an openable barrier provided adjacent adsorbent/absorbent material.

FIG. 15 shows a thin breakable membrane 128, comprising the isolating barrier, provided immediately adjacent the carbon adsorbent material 20, and shows a plunger 30 that is operated so as to break the membrane so as to activate the unit.

Figure 16:
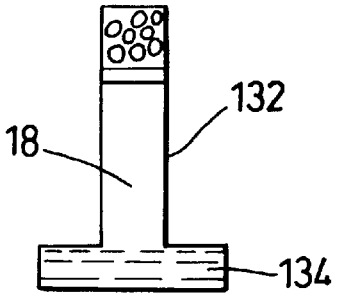
FIG. 16 shows an alternative shape for the cooling device.

FIG. 16 shows a housing 132 defining a closed chamber 18, but in this case the housing is not simply a cylindrical tube. The housing has an enlarged lower portion 134, which in this example is shown as a hollow disk. The level of evaporating liquid in the unit before use is roughly the same as the height of the disk, enlarged, portion of the unit.

The enlarged portion 134 may have greater heat exchange capability with the surrounding beverage (than a cylinder of uniform cross-section). In order to improve heat exchange we may provide fins/other surface-area enlarging structures.

It is probably more important to provide these features/the capability for a high rate of heat exchange, in the area of the housing that contacts the liquid water, rather than in an area which only contacts vaporised gas.

Figure 17:
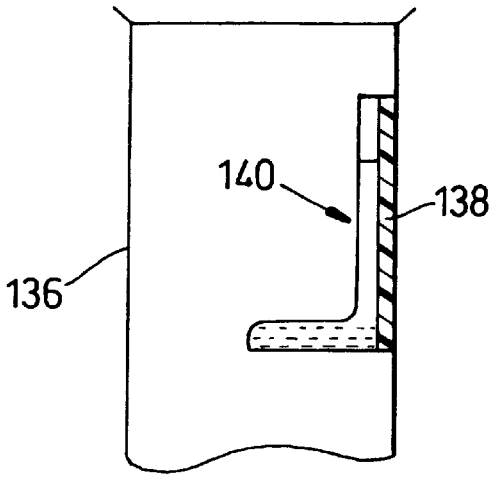
FIG. 17 shows another alternative shape for a cooling device, and an alternative place of mounting it in a can.

FIG. 17 shows another can, referenced 136, in which a plastics insulating member 138 is attached to the sidewall of the can (for example by adhesive, such as a two-part adhesive suitable for use in food systems), and cooler unit 140 is mounted to the side of the can, via the insulating member 138. Indeed, gluing the self-cooling unit to the can is one way of attaching it to the can, whatever the shape or arrangement of the unit.

This illustrates that the cooler unit need not necessarily be mounted to the can end, and need not necessarily have its actuation means provided on the top or the bottom of the can—it could be at the side of the can, but we prefer to provide it at the top.

FIG. 17 also shows another enlarged portion of the housing of the cooler unit.

Figure 18:
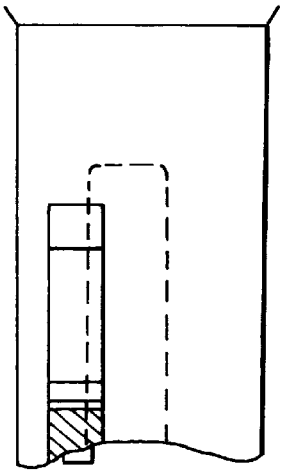
FIG. 18 shows a cooling device mounted on the base of a can.

FIG. 18 shows another can with the cooling unit provided on the bottom of the can at the base wall. A cooler unit could be provided off-set, as shown, or centrally, (as shown in dotted out-line). The actuation button for the cooler unit is received with the closed recess at the base of the can and does not project beyond the sidewalls of the can. This facilitates stacking of cans, and reduces the risk of setting the can off accidentally. A safety pin, or other manually-operable release device may be provided to prevent accidental triggering of the device.

Figure 19:
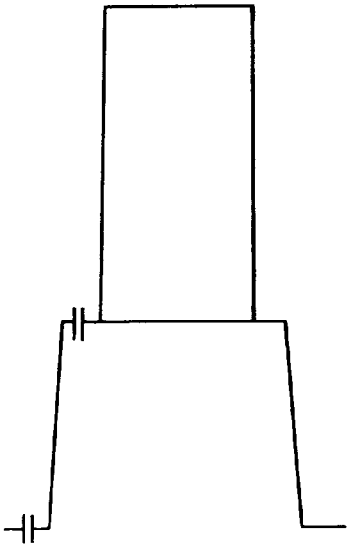
FIG. 19 shows a combined cooling device and head-generation widget adapted for retention in the can.

FIG. 19 shows a combined cooling unit and widget. As will be appreciated, it is well known to provide devices in cans to help generate a head when the can is opened, and the contents poured. The mounting of such widgets to the cans is a problem that has already been solved. We envisage "piggy-backing" a cooling device on a widget, so that the cooling device does not have to be separately mounted. This is especially attractive if the cooling device is operable by a change of pressure. The widget and cooling device could be an integral combined device.

The widget FIG. 19 is the widget of Bass Plc, and is a plastic "top-hat" widget having holes at different axially spaced positions, and is adapted to be glued to the domed base wall of the can. Of course, a metal widget can be used, or any other widget of any other manufacturer.

We may even provide the cooling device and the widget integrally moulded, or otherwise formed as one piece. This would reduce manufacturing costs, and reduce costs in comparison with inserting two separate components as two separate exercises into the can. This last effect can be achieved by having two discrete units attached together, and inserting them as a single unit.

Figure 20:
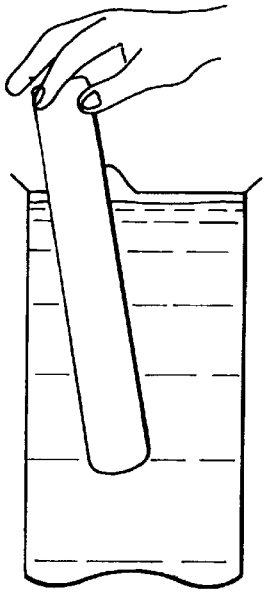
FIG. 20 shows a separate cooling device adapted for manual insertion into the can.

FIG. 20 shows a cooling unit much as described in with reference to other figures, but constructed as a stand-alone apparatus designed to be inserted into cans which have been opened (or other containers which are open). The can in this case could, of course, be a wholly conventional can.

Similarly, we envisage having kegs of liquor with the facility to insert a cooler unit of the kind described (albeit on a larger scale Than an in-can unit for a 440 ml can). This will be especially useful for outdoor events such as sports events or concerts where it is desired to have a temporary bar.

We could also envisage having kegs with built-in cooling devices, as well as "dip-in" cooling devices. For keg-use we would prefer to have the cooling device re-usable/re-chargeable. Perhaps the used devices could be detached from the keg and taken away to be recycled/recharged, and a new cooling device fitted from stock.

Figure 21:
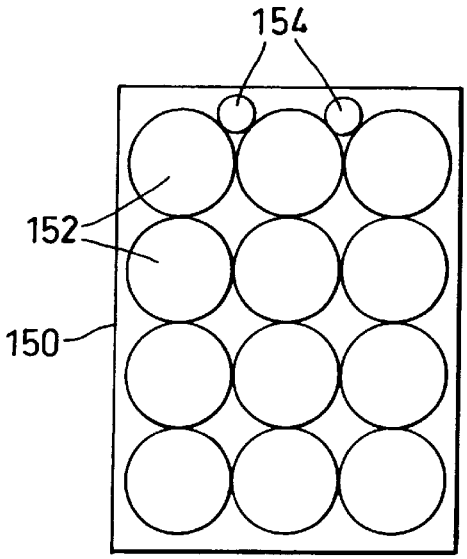
FIG. 21 shows a pack of twelve cans in a box with two cooling devices.

FIG. 21 shows a cardboard box 150 provided with twelve cans 152, and two stand-alone cooling units 154 retained within the box, and this example retained within the interstices between adjacent cans so as not to be protruding, and thus prone to damage when the box is closed.

Figure 22:
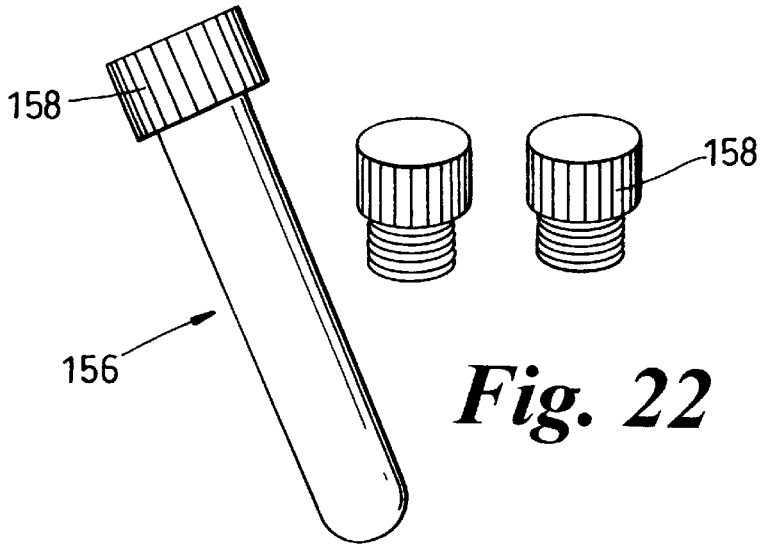
FIG. 22 shows a further cooling device, but with a removable cartridge at one end.

FIG. 22 illustrates a cooling unit 156 which is a stand-alone unit adapted to be dipped into something to be cooled (e.g. beverage in a glass or a beverage in a can, or foodstuff, or anything). It has a detachable cartridge 158 (in this case screw-threadedly detachable, but it could be push fit any other coupling). We would envisage supplying a plurality of cartridge 158, a plurality of breakable membranes (unless the cartridge has a valve mechanism which is re-usable), and the provision to re-introduce liquid water into the body of the unit so that the whole unit can be re-used. The cartridges 158 may be re-activatable, for example by heating in an oven/treating chemically.

Figure 23A:
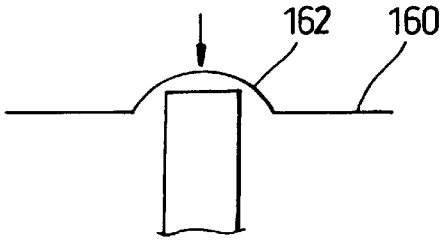
FIGS. 23*a* and 23*b* show a way of operating/actuating a cooling device.
Figure 23B:
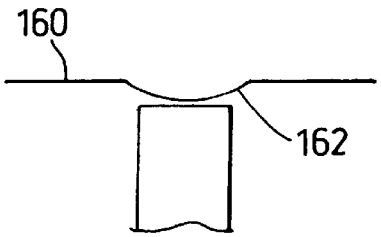

FIGS. 23*a* and 23*b* show one possibility of actuating a cooler unit. A wall of a container, reference 160, has a bi-stable portion 162 which can be moved from a first condition to a second condition manually by a user, and in so doing moves an element within a can to open the isolating barrier. To move to the second stable position the bi-stable area 162 maintains the isolating barrier open. Instead of a bi-stable area the can may simply have a flexible region.

Alternatively, there may simply be a region provided on a can which can be flexed by a user (e.g. by his finger or thumb) so as to open/break the isolating barrier. That region may be returned to its original condition after it has been flexed (e.g. it may spring back).

One possibility is providing cans, or bottles, of beverage in multi-pack units having a plurality of containers (e.g. a four-pack of cans held together at their tops by plastics webbing, or a box of cans or bottles). We may provide a multi-pack with all of its containers being self-cooling containers, but we may prefer to provide some of the packaged beverage containers of the multi-pack as conventional cans/bottles with no self-cooling ability. The conventional containers may have a head generation widget. For example, in a four-pack of cans, we may provide only one can as a self-cooling can, and the other three as normal cans. The cans (containers) of the multi-pack may all be substantially the same size, but may not all container the same volume of beverage. For example, the can or cans with a self-cooling unit inside may have less room for the beverage and may contain less beverage. One possibility is to have one or two self-cooling cans with about 270 ml or 300 ml of beverage and the rest of the multi-pack as cans with about 330 ml, 440 ml or 500 ml of beverage—i.e. the conventional cans may have about one third more beverage (or more) in them than the self-cooling cans. In a multi-pack (e.g. box) of containers with a lot of containers (e.g. 6, 8, 10 or 12) we may prefer to provide at least two self-cooling containers.

When a customer first buys a pack of cans of beverage, the packaged beverages often arrive home warm, and it may be advantageous to have one or two self-cooling cans for immediate consumption whilst the other conventional cans are put into a refrigerator to cool. By the time that the supply of self-cooling cans is exhausted, it may be that the conventional cans have cooled enough to be ready to drink.

What is claimed is:

1. A beverage pack comprising a container defining a chamber, beverage held in the chamber of the container, and beverage cooling means provided in the chamber of the container and comprising means selected from the group consisting of adsorption means and absorption means and a phase-change medium adapted in use to change phase and extract heat from the beverage.

2. A beverage pack according to claim 1, wherein a cooling unit is provided which defines a vaporisation chamber into which said phase-change medium is arranged to vaporise.

3. A beverage pack according to claim 1, wherein the cooling means comprises an in-container device.

4. A beverage pack according to claim 1 wherein isolation means is provided to isolate the one of the adsorption means and absorption means from the phase change medium until the cooling means is activated.

5. A beverage pack according to claim 1, wherein actuation means for activating the cooling means is arranged to operate upon opening of the container, for example, by responding to a change in pressure consequent upon opening of the container.

6. A beverage pack comprising a container, beverage held in the container, and beverage cooling means provided in, or in association with, the container and comprising a phase-change medium adapted in use to change phase and extract heat from the beverage, and means selected from the group consisting of adsorption means and absorption means provided in use to adsorb or absorb the phase-change medium, the one of the adsorption means and absorption means being one or more of: activated carbon, ammonium nitrate, and a polymer.

7. A beverage pack according to claim 1 wherein one of the adsorption means and the absorption means comprises a substance which one of adsorbs and absorbs vapor without getting hot.

8. A beverage pack according to claim 1, wherein the phase change medium is aqueous.

9. A beverage pack according to claim 2, wherein a sub-atmospheric pressure is provided in the cooling means above the phase change medium.

10. A beverage pack according to claim 8, wherein said sub-atmospheric pressure and said phase change medium are so selected that, when at such pressure, said phase change medium boils at a temperature not exceeding 20° C.

11. A beverage pack according to claim 1 wherein the one of the adsorption means and the absorption means is provided in a detachable cartridge.

12. A cooling unit adapted for placement into a chamber defined by a container to cool beverage in the chamber of the container, the unit comprising a phase change medium adapted to change phase and extract heat from the beverage and means selected from the group consisting of adsorption means and absorption means.

13. A method of cooling a beverage disposed in a chamber defined by a container including a beverage cooling means disposed in the chamber and having a phase change medium and means selected from the group consisting of adsorption means and absorption means, the method comprising extracting heat from the beverage by use of a phase change of the phase change medium.

14. A beverage pack comprising a container defining a chamber, the beverage held in the chamber of the container, and beverage cooling means provided in the chamber of the container and comprising means selected from the group consisting of adsorption means and absorption means and an aqueous phase-change medium adapted in use to change phase and extract heat from the beverage.

15. The beverage pack of claim 14, further comprising isolation means configured to isolate one of the adsorption means and the absorption means from the phase-change medium until the cooling means is activated.

16. The beverage pack according to claim 14, further comprising actuation means for activating the cooling means, wherein the actuation means is arranged to operate upon opening of the container.

17. A beverage pack comprising a container the beverage held in the container, and beverage cooling means provided in, or in association with, the container and comprising an aqueous phase-change medium adapted in use to change phase and extract heat from the beverage, and means selected from the group consisting of adsorption means and absorption means configured to one of adsorb and absorb the phase-change medium, the one of the adsorption means and the absorption means being provided in a detachable cartridge.

18. A beverage pack comprising a container defining a chamber, the beverage held in the chamber of the container, and beverage cooling means provided in the chamber of the container and comprising an aqueous phase-change medium adapted in use to change phase and extract heat from the beverage and means selected from the group consisting of adsorption means and absorption means, a sub-atmospheric pressure provided in the cooling means and said phase-change medium are so selected that, when at such pressure, said phase-change medium boils at a temperature not exceeding 20° C.

19. The beverage pack of claim 18, further comprising isolation means configured to isolate one of the adsorption means and the absorption means from the phase-change medium until the cooling means is activated.

20. A beverage pack comprising:

a container, the beverage held in the container; and beverage cooling means provided in, or in association with, the container and comprising, a phase-change medium adapted in use to change phase and extract heat from the beverage, and means selected from the group consisting of adsorption means and absorption means provided in use to one of adsorb and absorb the phase-change medium, the one of the adsorption means and the absorption means provided in a detachable cartridge.

21. The beverage pack of claim 20, wherein the phase-change medium is aqueous.

22. The beverage pack of claim 20, further comprising isolation means configured to isolate the one of the adsorption means and the absorption means from the phase-change medium until the cooling means is activated.

23. The cooling unit of claim 12, wherein the phase-change medium is aqueous.

24. The cooling unit of claim 12, wherein a sub-atmospheric pressure is provided in the cooling unit above the phase-change medium.

25. The cooling unit of claim 24, wherein the sub-atmospheric pressure and the phase-change medium are selected such that, the phase-change medium boils at a temperature not exceeding 20° C.

* * * * *